US008561776B2

(12) United States Patent
Mirumachi et al.

(10) Patent No.: US 8,561,776 B2
(45) Date of Patent: Oct. 22, 2013

(54) IMAGING UNIT AND COIN IDENTIFYING APPARATUS

(75) Inventors: Naofumi Mirumachi, Saitama (JP); Masao Mori, Saitama (JP); Masataka Takahashi, Matsudo (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 0 days.

(21) Appl. No.: 13/430,830

(22) Filed: Mar. 27, 2012

(65) Prior Publication Data

US 2012/0247918 A1 Oct. 4, 2012

(30) Foreign Application Priority Data

Mar. 30, 2011 (JP) ..... 2011-076340

(51) Int. Cl.
*G07D 5/00* (2006.01)
*G07D 5/02* (2006.01)

(52) U.S. Cl.
USPC ..... 194/302; 73/163

(58) Field of Classification Search
USPC ..... 194/302, 328, 329, 330, 332, 333; 453/4; 73/163; 382/136
See application file for complete search history.

(56) References Cited

U.S. PATENT DOCUMENTS

| | | | | |
|---|---|---|---|---|
| 6,688,449 | B1 * | 2/2004 | Yamagishi | 194/328 |
| 2001/0005264 | A1 * | 6/2001 | Slemon et al. | 356/237.2 |
| 2008/0212089 | A1 * | 9/2008 | Rosengaus | 356/300 |

FOREIGN PATENT DOCUMENTS

| | | | |
|---|---|---|---|
| DE | 20004826 | U1 | 6/2000 |
| FR | 2360138 | A1 | 2/1978 |
| JP | 6-150104 | | 5/1994 |
| JP | 9-319911 | | 12/1997 |
| JP | 11014557 | A | 1/1999 |
| JP | 2000-331211 | | 11/2000 |
| JP | 2001-34804 | | 2/2001 |

OTHER PUBLICATIONS

EP Search Report in EP 12 16 1373 dated Jul. 9, 2012.

Korean Office Action mailed Jun. 19, 2013 in Korean Patent Application No. 10-2012-0031135 and Entlish translation, 7 pp.

* cited by examiner

*Primary Examiner* — Mark Beauchaine
(74) *Attorney, Agent, or Firm* — Nixon & Vanderhye P.C.

(57) ABSTRACT

An imaging unit images a subject having an unevenness pattern on a surface. The imaging unit includes: a surface light source that emits with a constant output illumination light illuminating the surface of the subject; an imager that receives reflected light reflected by the surface of the subject; and a beam splitter that is arranged at a location at which the illumination light emitted from the surface light source and the reflected light incident on the imager intersect with each other. The illumination light emitted from the surface light source is incident on the surface of the subject via the beam splitter. The reflected light reflected by the surface of the subject is incident on the imager via the beam splitter. The illumination light incident on the surface of the subject includes parallel light that is perpendicularly incident on the surface of the subject, and diffused light.

5 Claims, 9 Drawing Sheets

IMAGING UNIT AND COIN IDENTIFYING APPARATUS

BACKGROUND OF THE INVENTION

1. Field of the Invention

The present invention relates to an imaging unit and a coin identifying apparatus.

Priority is claimed on Japanese Patent Application No. 2011-076340, filed Mar. 30, 2011, the content of which is incorporated herein by reference.

2. Description of Related Art

There is known a coin identifying apparatus that images a surface of a coin, and identifies the coin from the unevenness pattern of the coin surface that appears in the acquired image. That kind of coin identifying apparatus successively conveys a plurality of coins on a conveyance route, and when the coins pass an imaging location that is provided on that conveyance route, that coin is imaged by the imaging unit. That imaging unit includes a light source that emits illumination light that illuminates the coin surface, and an imager that receives the reflected light that is reflected by the coin surface (see, for example, Japanese Unexamined Patent Application, First Publication No. H09-319911 (hereinbelow referred to as Patent Document 1) and Japanese Unexamined Patent Application, First Publication No. H06-150104 (hereinbelow referred to as Patent Document 2)).

In the imaging unit that is disclosed in Patent Document 1, the light source is arranged away from the normal direction of the coin surface, and the imager is arranged in the normal direction of the coin surface. The illumination light that is emitted from the light source is obliquely incident on the coin surface, and the imager mainly receives the reflected light that is reflected by the edge portion of the unevenness pattern of the coin surface. Contrast is generated between the edge portion of the unevenness pattern of the coin surface and the other portion in the image that is obtained by this imaging unit. However, since this imaging unit receives by the imaging unit the reflected light that has been reflected at the edge portion of the unevenness pattern of the coin surface, it is difficult to detect the defaced state and color of the coin surface.

In the imaging unit that is disclosed in Patent Document 2, a surface light source that emits parallel light is used as the light source. The surface light source is arranged in the normal direction of the coin surface. A half mirror is arranged between the surface light source and the coin. An imager is arranged in the optical path of the light beam that advances in the normal direction of the coin surface and is reflected by the half mirror. The illumination light (parallel light) that is emitted from the surface light source passes through the half mirror to be perpendicularly incident on the coin surface. The imager receives the reflected light that is mainly reflected by the coin surface excluding the edge portion of the unevenness pattern, and reflected by the half mirror. Contrast is generated between the edge portion of the unevenness pattern of the coin surface and the other portion in the image that is obtained by this imaging unit. Moreover, it is also possible to detect the defaced state and color of the coin surface with this imaging unit.

However, in the imaging unit that is disclosed in Patent Document 2, in the case of the defacement of the coin surface being severe, or the coin surface being a diffusing surface, the brightness of the coin surface is overall insufficient. As a result, the contrast between the edge portion of the unevenness pattern and the other portion of the coin surface in the acquired image becomes indistinct, and identification sometimes cannot be performed. As a solution in such a case, adjusting the output of the light source in accordance with the nature of the coin surface leads to a drop in the identification process speed in a coin identifying apparatus that images a plurality of coins in succession.

SUMMARY OF THE INVENTION

An object of the present invention is to provide an imaging unit that, while holding constant the output of a light source, can reliably capture the unevenness pattern of the surface of a subject without being influenced by the nature of the surface of the subject. Also an object of the present invention is to provide a coin identifying apparatus that has excellent identification processing speed.

An imaging unit according to the present invention images a subject having an unevenness pattern on a surface. The imaging unit includes: a surface light source that emits with a constant output illumination light illuminating the surface of the subject; an imager that receives reflected light reflected by the surface of the subject; and a beam splitter that is arranged at a location at which the illumination light emitted from the surface light source and the reflected light incident on the imager intersect with each other. The illumination light emitted from the surface light source is incident on the surface of the subject via the beam splitter. The reflected light reflected by the surface of the subject is incident on the imager via the beam splitter. The illumination light incident on the surface of the subject includes parallel light that is perpendicularly incident on the surface of the subject, and diffused light.

A coin identifying apparatus according to the present invention includes: a conveying unit that conveys a coin; the above-described imaging unit imaging a surface of the coin that is conveyed by the conveying unit; and an identifying unit that identifies the coin based on an image acquired by the imaging unit.

According to the present invention, an imaging unit emits illumination light that includes parallel light and diffused light to a surface of a subject. The brightness of the overall surface of the substrate is ensured by the diffused light, and thereby the contrast of the edge portion of the unevenness pattern of the surface of the substrate and the other portion of the surface of the substrate that is produced by parallel light becomes distinct. Thereby, while holding constant the output of a light source, it can reliably capture the unevenness pattern of the surface of the subject without being influenced by the nature of the surface of the subject. Moreover, according to a coin identifying apparatus that includes the imaging unit, it is possible to keep the identification processing speed.

DETAILED DESCRIPTION OF THE INVENTION

Figure 1:
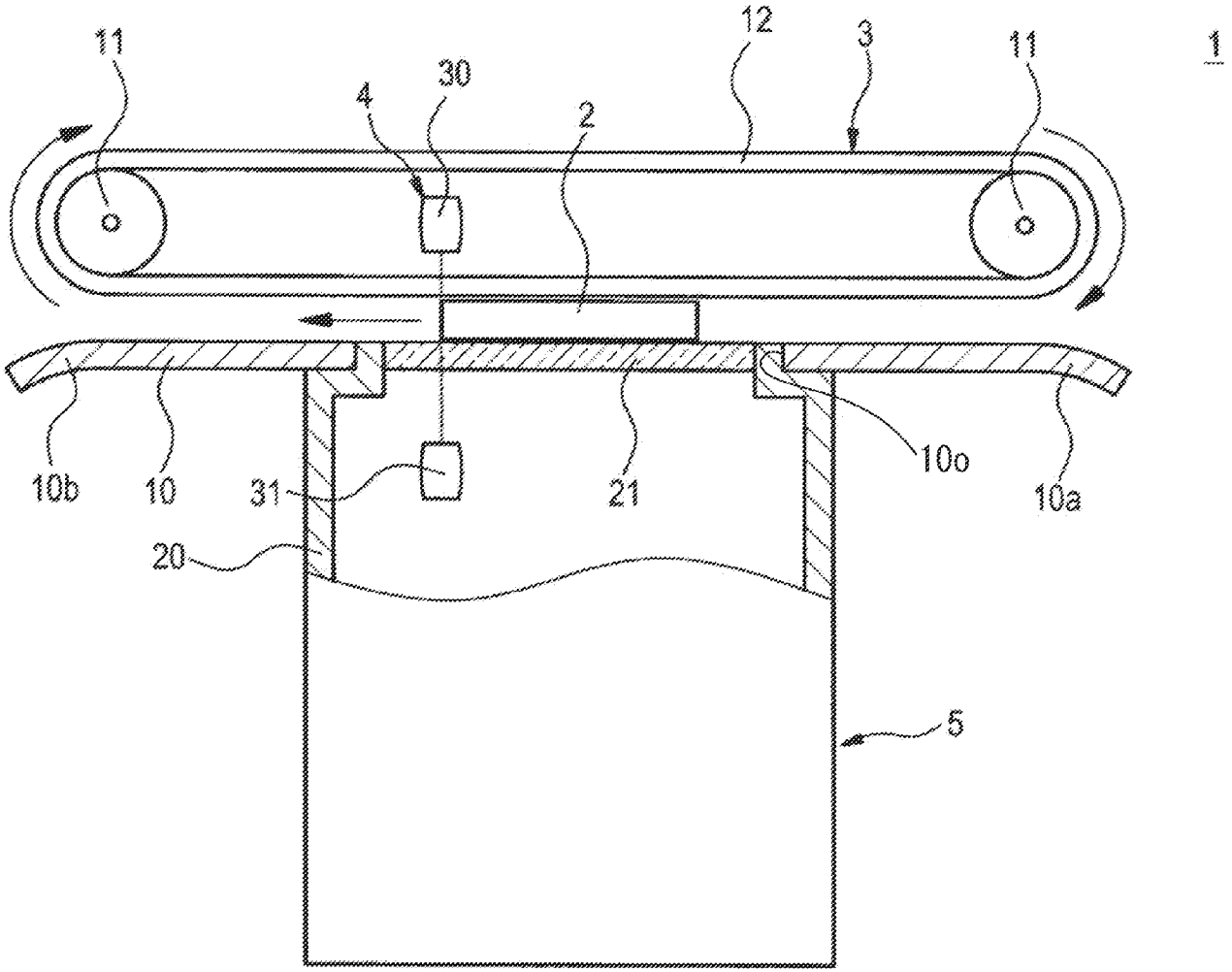
FIG. 1 shows one example of a coin identifying apparatus for describing an embodiment of the present invention.
Figure 2:
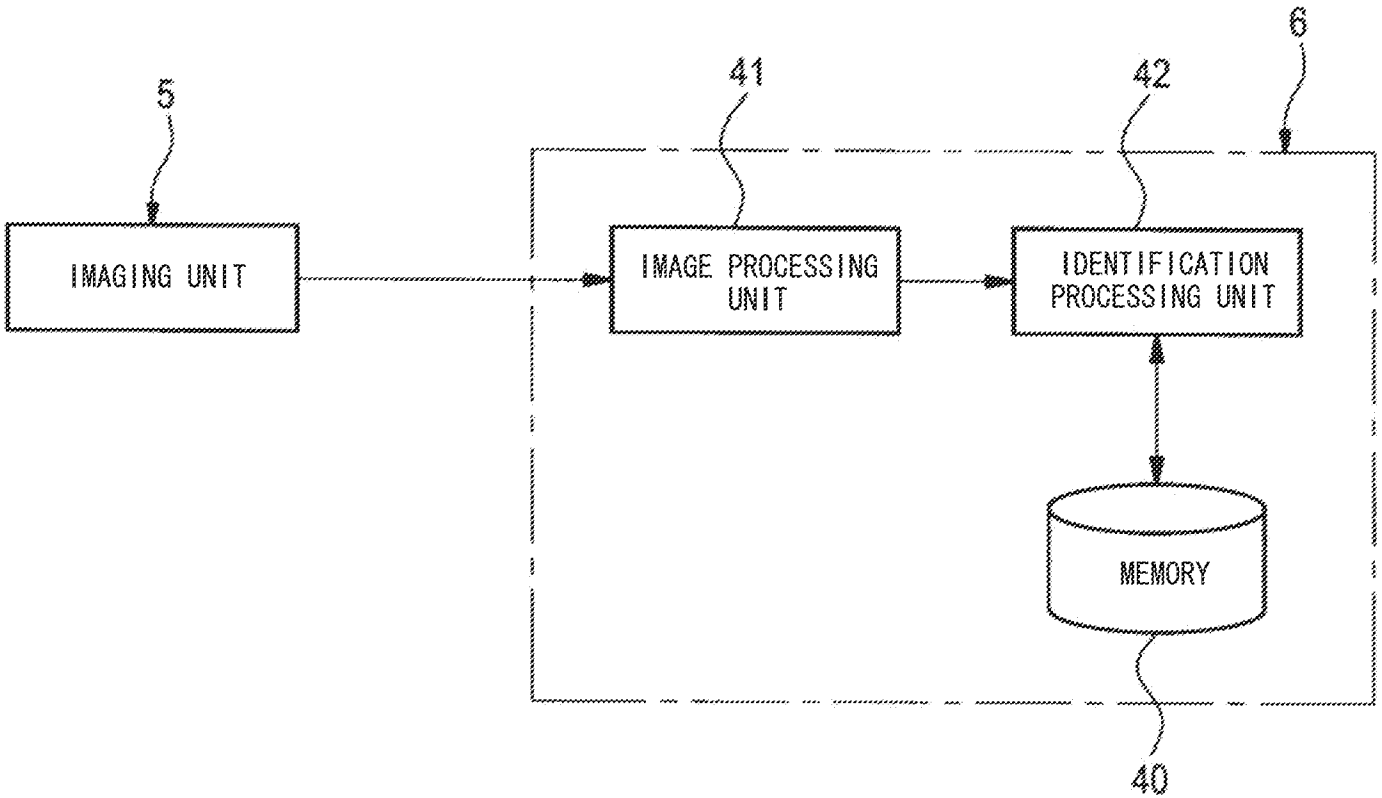
FIG. 2 is a block diagram showing an identification system of the coin identifying apparatus in FIG. 1.

FIG. 1 shows an example of a coin identifying apparatus according to an embodiment of the present invention. FIG. 2 is a block diagram showing an identification system of the coin identifying apparatus shown in FIG. 1.

The coin identifying apparatus shown in FIG. 1 and FIG. 2 includes a conveying unit 3, a detecting unit 4, an imaging unit 5, and an identifying unit 6. The conveying unit 3 conveys a coin 2. The detecting unit 4 detects the coin 2 that is conveyed. The imaging unit 5 images a surface of the coin 2 that is conveyed. The identifying unit 6 identifies the coin 2 based on the image that is acquired by the imaging unit 5.

The conveying unit 3 includes a conveying table 10, a pair of pulleys 11, and an endless belt 12. The conveying table 10 specifies the conveying path of the coins 2. The endless belt 12 is mounted on the pair of pulleys 11. The pair of pulleys 11 are respectively arranged at both end portions of the conveying table 10 in the extending direction of the conveying table 10, and are driven by a motor not illustrated. The endless belt 12 is arranged facing the conveying table 10. A space between the endless belt 12 and the conveying table 10 is set to be able to suitably take in the coin 2.

The conveying table 10 has a one end portion 10*a* (hereinbelow referred to as the upstream side end portion) and the other end portion 10*b* (hereinbelow referred to as the downstream side end portion). The position of the upstream side end portion 10*a* corresponds to the upstream side of the conveying path. The position of the downstream side end portion 10*b* corresponds to the downstream side of the conveying path. A plurality of coins that are inserted into a coin slot, not illustrated, of the coin identifying apparatus 1 are successively supplied to the upstream side end portion 10*a*. The endless belt 12 is rotationally driven at a constant speed by the motor and the pair of pulleys 11. The coins 2 that are supplied to the upstream side end portion 10*a* on the conveying table 10 are caught in the space between the endless belt 12, and the transport table 10. Those coins 12 move on the conveying table 10 while being dragged by the endless belt 12 by the friction with the endless belt 12, and are conveyed to the downstream side end portion 10*b* of the conveying table 10 along the conveying path.

The imaging unit 5 is arranged on the lower surface side of the conveying table 10, that is to say, the side opposite to the endless belt 12 with respect to the conveying table 10. The imaging unit 5 approaches the middle region (midstream) of the conveying path. An opening 10*o* is formed in the central portion of the conveying table 10 that corresponds to as the middle region of the conveying path. A plate-shaped transparent member 21 that serves as a portion of a case 20 of the imaging unit 5 is fitted in this opening 10*o*. The transparent member 21 is formed for example with sapphire glass or the like. The surface of the transparent member 21 is flush with the upper surface of the conveying table 10. The coins 2 that are conveyed along the conveying path pass over the transparent member 21. The location of imaging by the imaging unit 5 is at the transparent member 21 in the conveying path. When the coins 2 being conveyed pass through the imaging location, the imaging unit 5 images the coins 2.

The detecting unit 4 detects the coins 2 at the timing in which the coins 2 being conveyed pass through the imaging location. The detecting unit 4, in the illustrated example, includes a light emitting element 31 and a light-receiving element 30 that form a pair.

The light emitting element 31 is incorporated in the imaging unit 5 and emits light toward the transparent member 21. For example, an LED (light emitting diode) or the like may be used as the light emitting element 31. The light receiving element 30 is arranged on the upper surface side of the conveying table 10, and opposite the light emitting element 31. The light receiving element 30 receives the light that is emitted from the light emitting element 31 and passes through the transparent member 21. For example, a photodiode or the like may be used as the light receiving element 30. When the coin 2 is at the imaging location, the light from the light emitting element 31 to the light receiving element 30 is blocked by the coin 2. By detecting that the light reception by the light receiving element 30 has been blocked, the detecting unit 4 detects the coin 2 at the imaging location. The imaging unit 5 performs imaging in synchronization with the detecting unit 4 detecting the coin 2. In the illustrated example, the pair of the light emitting element 31 and the light receiving element 30 are arranged in the downstream region of the imaging location. However, the position of the light emitting element 31 and the light receiving element 30 is not particularly limited, and they may be arranged in the upstream region of the imaging location.

The identifying unit 6 includes a memory 40, an imaging processing unit 41, and an identification processing unit 42.

The memory 40 stores coin data including unevenness pattern data relating the unevenness patterns of the surfaces of various coins. The image processing unit 41 receives an input of the image data of the surface of the coin 2 that has been imaged by the imaging unit 5. The image processing unit 41 analyzes this image data, and produces imaged coin data that includes unevenness pattern data of the imaged coin. The identification processing unit 42 receives an input of the imaged coin data that is produced by the image processing unit 41. The identification processing unit 42, by extracting the coin data that matches the imaged coin data, from the coin data of various coins that are stored in the memory 40, identifies the coin 2 that has been imaged by the imaging unit 5.

The coin data and the imaged coin data may include, in addition to the unevenness pattern data of the surfaces of the coins, for example chromaticity data or brightness data relating to the color of the surface of a coin. The chromaticity data can be used for identifying coins together with the unevenness pattern. Also, it is possible to detect the defaced state of the surface of a coin using the chromaticity data and the brightness data.

Figure 3:
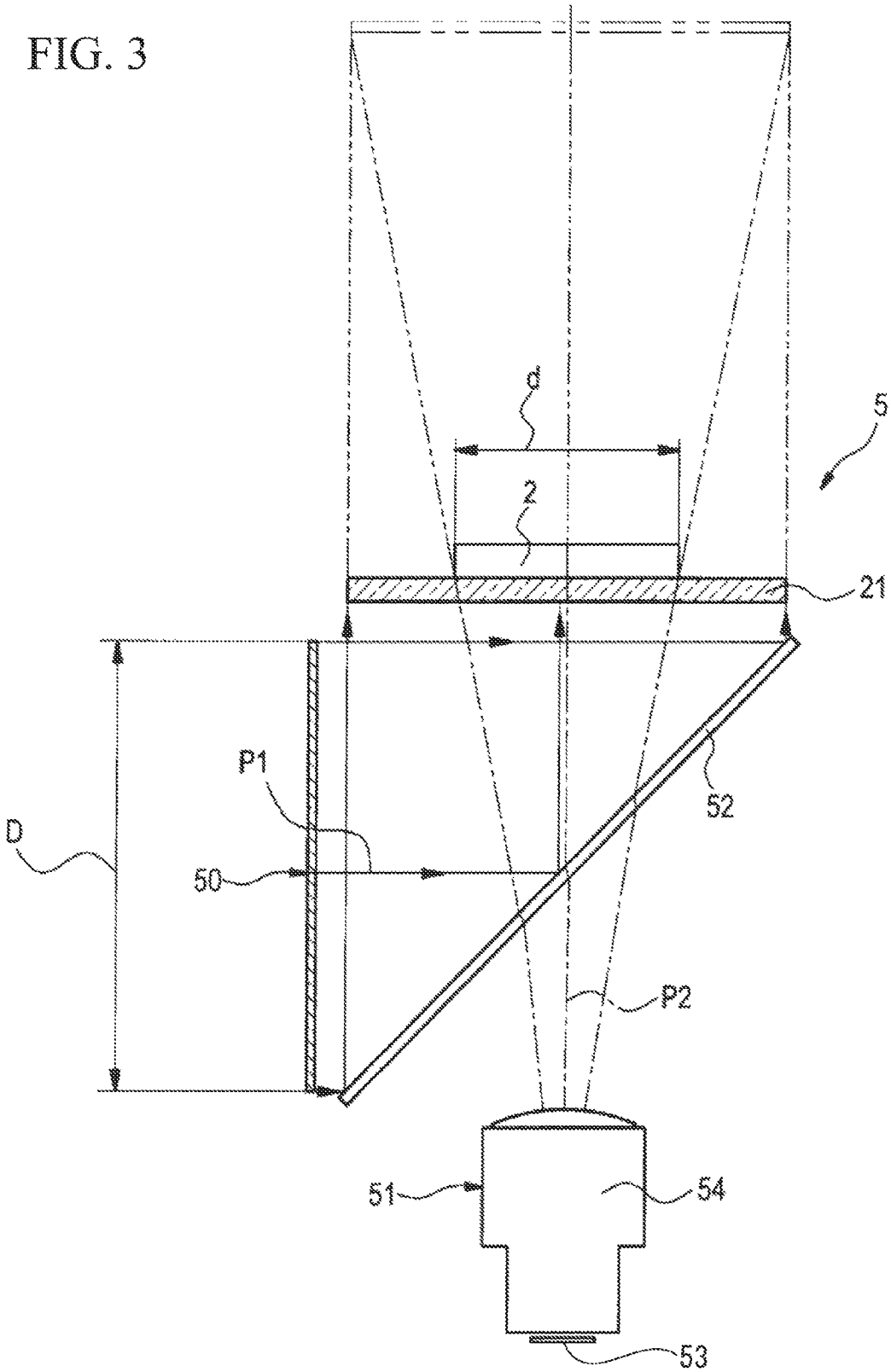
FIG. 3 shows an imaging unit of the coin identifying apparatus in FIG. 1, being an example of an imaging unit for describing the embodiment of the present invention.

FIG. 3 shows the imaging unit 5 of the coin identifying apparatus 1 in FIG. 1.

The imaging unit 5 that is shown in FIG. 3 is provided with a surface light source 50, an imager 51, and a beam splitter 52.

The surface light source 50 emits with a constant output illumination light that illuminates a surface of the coin 2 being imaged. The illumination light is made to have a substantially uniform illuminance over the entire region of the imaging location, that is to say, over the whole surface of the transparent member 21. The detailed constitution of the surface light source 50 shall be described below.

The imager 51 includes a solid state imaging element 53 and an imaging optics (optical image forming system) 54. The solid state imaging element 53 may be for example a CCD (charge coupled device) image sensor or a CMOS (complementary metal oxide semiconductor) image sensor. The imaging optics 54 forms an image on the image reception area of the solid state imaging element 53. The imager 51 receives reflected light that is reflected by the surface of the coin 2.

The beam splitter 52 transmits a portion of the incident light, and reflects the remainder. As the beam splitter 52, a half mirror may typically be used in which the ratio of transmittance and reflectance are equivalent.

The beam splitter 52 is arranged at a location at which the illumination light that is emitted from the surface light source 50 and the reflected light that is incident on the imager 51 intersect. The illumination light that is emitted from the surface light source 50 is incident on the surface of the coin 2 via the beam splitter 52, and the reflected light that is reflected by the surface of the coin 2 is incident on the imager 51 via the beam splitter 52.

In greater detail, the beam splitter 52 is positioned in the normal direction of the surface of the coin 2 with respect to the coin 2. The surface light source 50 is arranged in the optical path of the light that advances in the normal direction of the surface of the coin 2 and is reflected by the beam splitter 52. The imager 51 is arranged in the optical path of light that advances in the normal direction of the surface of the coin 2 and penetrates the beam splitter 52. A portion of the illumination light that is emitted from the surface light source 50 and incident on the beam splitter 52 is reflected by the beam splitter 52 to be incident on the surface of the coin 2. A portion of the reflected light that is reflected by the surface of the coin 2 and incident on the beam splitter 52 penetrates the beam splitter 52 to be incident on the imager 51. That is to say, this imaging unit 5 images by coaxial epi-illumination (coaxial incident illumination).

The illumination light that is emitted from the surface light source 50 includes parallel light and diffused light. An example of the surface light source 50 that emits that kind of illumination light is explained below.

Figure 4:
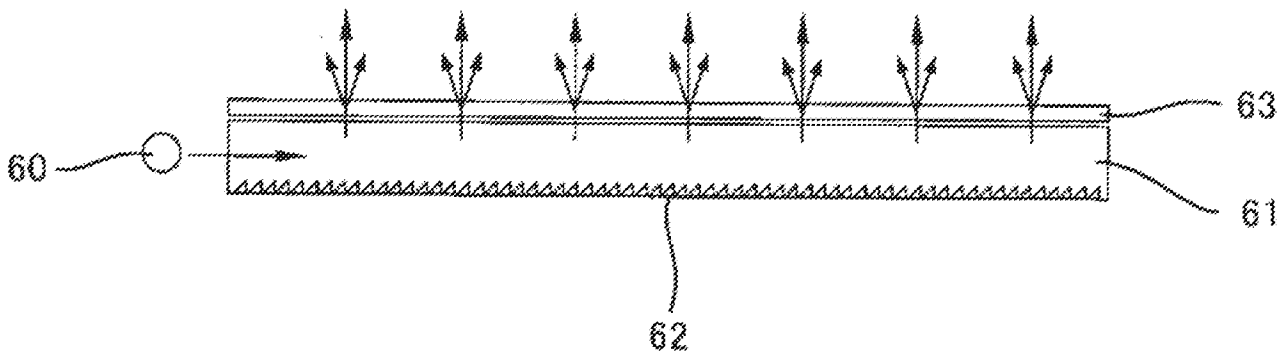
FIG. 4 shows an example of a surface light source of the imaging unit in FIG. 3.

FIG. 4 shows the surface light source 50 of the imaging unit 5 in FIG. 3.

The surface light source 50 shown in FIG. 4 is a so-called edge-light type surface light source, and has a light source element 60, a light guide plate 61, and a diffusion film 63.

As the light source element 60, a cold cathode tube, a white LED or the like that emits white light, for example, may be used. The light source element 60 is arranged along a side face of the light guide plate 61. If data relating to the color of the surface of a coin (chromatic data and brightness data) is not required in the identification of coins by the aforementioned identifying unit 6, the light source element 60 may be a light source element that emits monochromatic light.

The light guide plate 61 may be formed by acrylic, for example. A fine prism pattern 62 is formed on the lower surface of the light guide plate 61. Light that has been emitted from the light source element 60 is incident on the side face of the light guide plate 61 and guided to inside the light guide plate 61, and reflected by the prism pattern 62 on the lower surface of the light guide plate 61. As a result, that light is emitted from the upper surface of the light guide plate 61 in the normal direction of the upper surface thereof.

The diffusion film 63 is layered on the upper surface of the light guide plate 61, which is the emission face. The diffusion film 63 forms the emission face of the surface light source 50. A portion of the light that is emitted from the upper surface of the light guide plate 61 is dispersed by passing through the diffusion film 63.

The illumination light that is emitted from the surface light source 50 that is constituted as described above includes the above-mentioned parallel light that advances in the normal direction of the emission face, and diffused light, by the property of the light guide plate 61 and the property of the diffusion film 63 being combined. The diffused light includes light advancing obliquely with respect to the normal direction of the emission face. Including diffused light in the illumination light contributes to equalization of the illuminance distribution at the imaging location where this illumination light is to be irradiated. This diffused light includes light that is obliquely incident on the surface of the coin 2.

The surface light source 50 is arranged so that the emission face the surface light source 50 intersects the optical path of light that advances in the normal direction of the surface of the coin and is reflected by the beam splitter 52. The parallel light that is included in the illumination light is reflected by the beam splitter 52, and is perpendicularly incident on the surface of the coin 2. The diffused light that is included in the illumination light is also reflected by the beam splitter 52 and incident on the surface of the coin 2.

Figure 5:
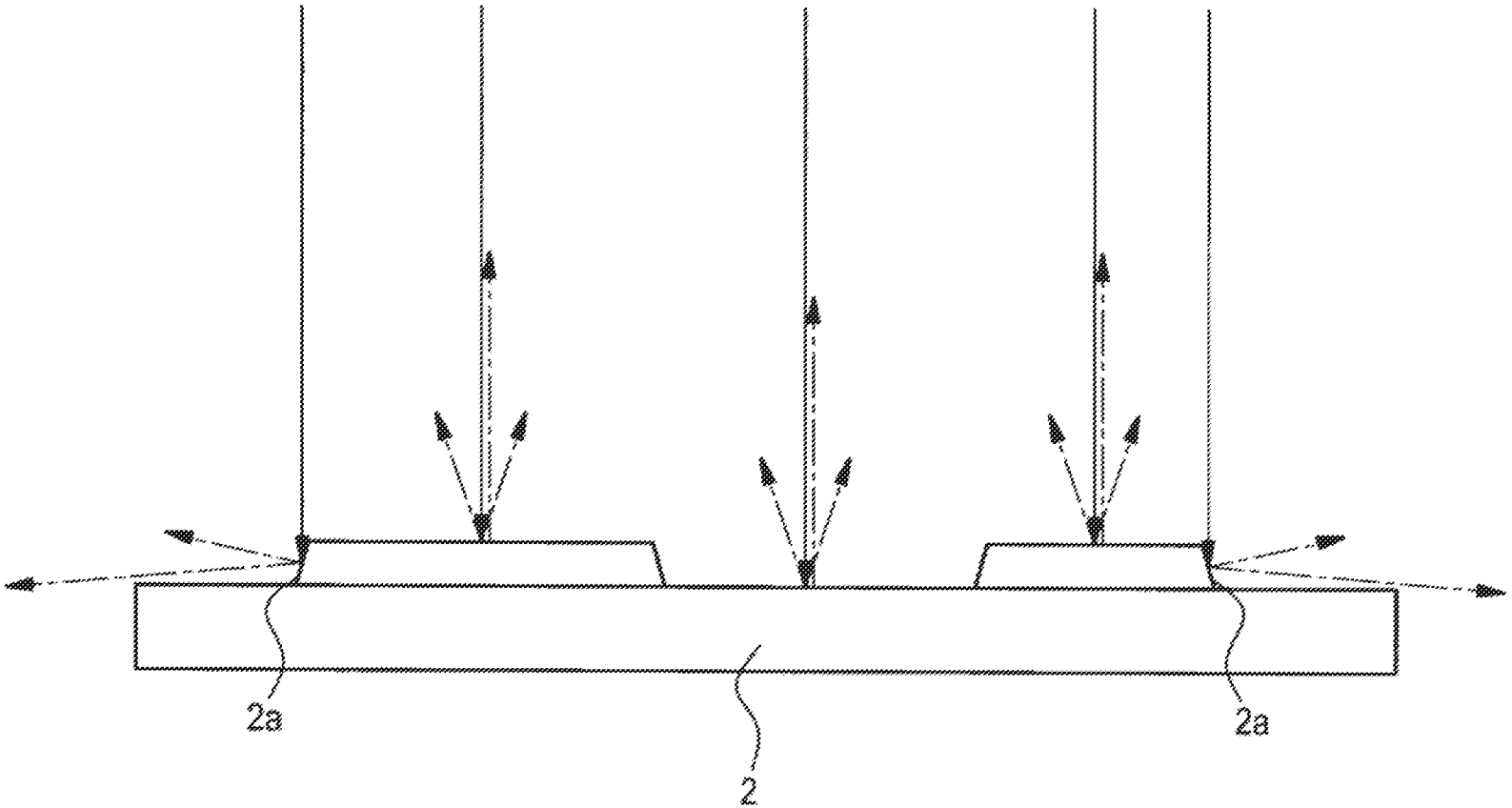
FIG. 5 schematically shows the illumination light that is incident on the surface of a coin, and the reflected light that is reflected by the surface of the coin.

FIG. 5 schematically shows the illumination light that is incident on the surface of the coin 2 and the reflected light that is reflected by the surface of the coin 2.

The parallel light that is perpendicularly incident on the surface of the coin 2 excluding the edge portion 2*a* of the unevenness pattern of the surface of the coin 2 is reflected by the surface of the coin 2, and most of that reflected light returns to the beam splitter 52, and by penetrating the beam splitter 52, is received by the imager 51. On the other hand, the parallel light that is incident on the edge portion 2*a* of the unevenness pattern is reflected by the edge portion 2*a*, but most of that reflected light does not head to the beam splitter 52, so that the reflected light that is reflected by the edge portion 2*a* and returns to the beam splitter 52 remarkably decreases. Thereby, in the image that is captured by the imager 51, contrast (a brightness difference) is produced between the edge portion 2*a* of the unevenness pattern of the surface of the coin 2 and the other portion of the surface of the coin 2. In the identification of a coin by the identifying unit 6 mentioned above, the image processing unit 41 extracts the unevenness pattern based on this contrast, and generates unevenness pattern data.

Also, the diffused light that is incident on the surface of the coin 2 raises overall the brightness of the surface of the coin 2. As a result, the brightness of the entire surface of the coin 2 is ensured even when the defacement of the surface of the coin 2 is severe, or when the surface of the coin 2 is a diffusing surface. Thereby, the contrast between the edge portion 2*a* of the unevenness pattern of the surface of the coin 2 and the other portion of the surface of the coin 2 that is produced by the parallel light becomes distinct without blocked-up shadows. Therefore, it is possible to reliably capture the unevenness pattern of the surface of the coin 2 without being swayed by the nature of the surface thereof, while holding constant the output of the surface light source 50. Consequently, it is possible to maintain the identification processing speed in the coin identifying apparatus 1 including the aforementioned imaging unit 5.

In the aforementioned example, taking the coin identifying apparatus 1 as an example, the case was described of the imaging unit 5 imaging coins. However, the subject is not limited to a coin. For example, it is possible to have a diskshaped article having an unevenness pattern on a surface, with the reflectance of the surface (specular reflectivity) approximating a coin, such as a medal or the like, serve as the subject.

Figure 6:
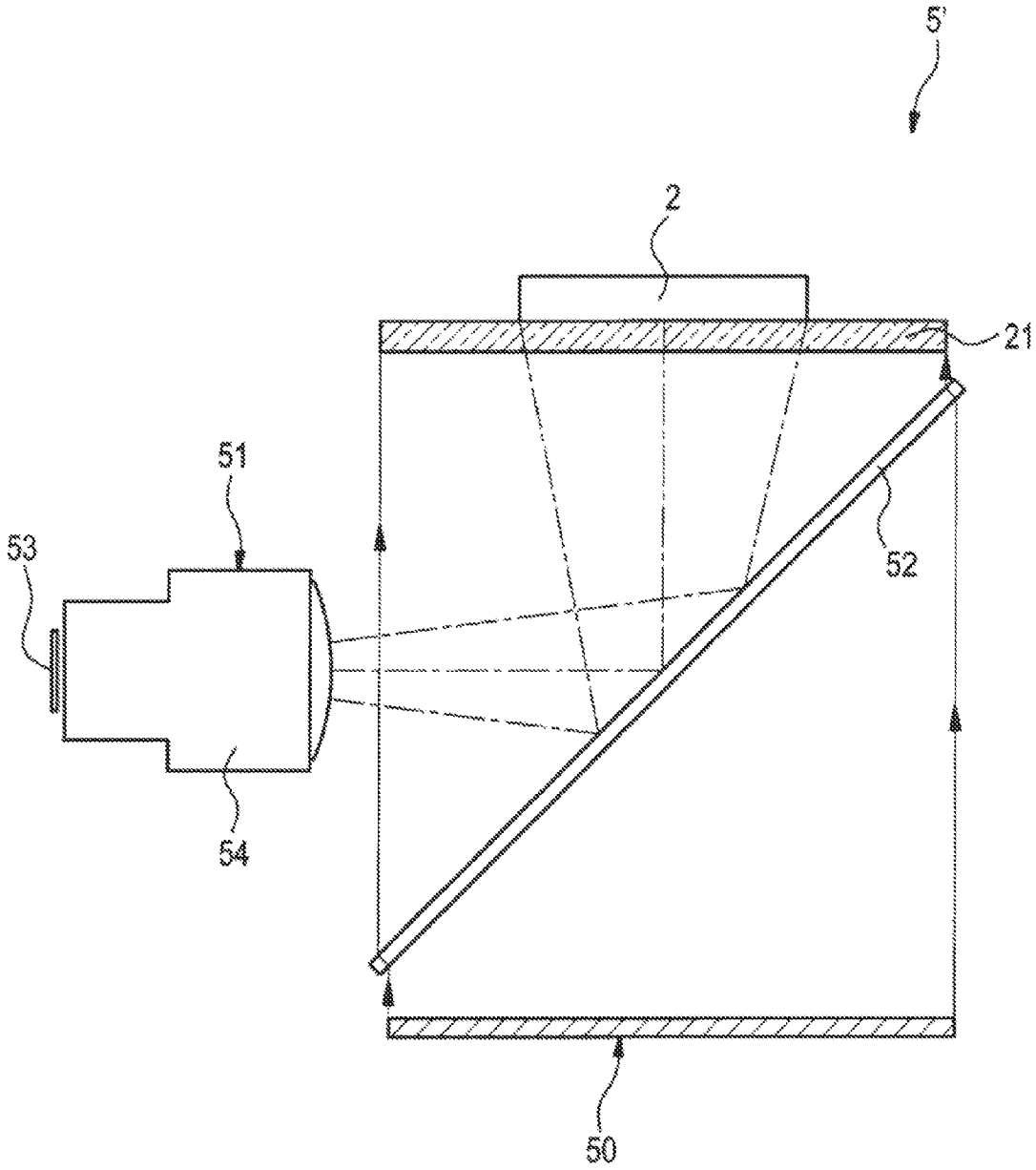
FIG. 6 shows a modification example of the imaging unit in FIG. 3.

FIG. 6 shows a modification of the imaging unit 5 shown in FIG. 3.

The imaging unit 5' shown in FIG. 6 performs imaging by coaxial epi-illumination. In the imaging unit 5', the arrangement of the surface light source 50 and the imager 51 differ from the imaging unit 5 that is shown in FIG. 3 in relation to the beam splitter 52. The beam splitter 52 is positioned in the normal direction of the surface of the coin 2 with respect to the coin 2. The surface light source 50 is arranged in the optical path of the light that advances in the normal direction of the surface of the coin 2 and penetrates the beam splitter 52. The imager 51 is arranged in the optical path of the light that advances in the normal direction of the surface of the coin 2 and is reflected by the beam splitter 52. A portion of the illumination light that is emitted from the surface light source 50 and incident on the beam splitter 52 penetrates the beam splitter 52 to be incident on the surface of the coin 2. A portion of the reflected light that is reflected by the surface of the coin 2 and incident on the beam splitter 52 is reflected by the beam splitter 52 to be incident on the imager 51.

In the imaging unit 5 shown in FIG. 3 and the imaging unit 5' shown in FIG. 6, the imaging optics that is included in the imager 51 is made to be a non-telecentric imaging optics. The surface light source 50 emitting illumination light with a substantially uniform illuminance over the entire surface of the coin 2 means that the surface light source 50 projects onto the entire surface of the coin 2. For example, in the imaging unit 5 shown in FIG. 3, it is assumed as follows. The optical path length of the optical path P1 of the illumination light that is emitted from the surface light source 50 and reaches the surface of the coin 2 is expressed as "PL1". The optical path length of the optical path P2 of the reflected light that is reflected by the surface of the coin 2 and reaches the imager 51 is expressed as "PL2". The diameter of the coin is expressed as "d". Also, the diameter of the surface light source 50 is expressed as "D". In this case, the diameter D of the surface light source 50 has a size of at least "d×(PL1+PL2)/PL2".

Figure 7:
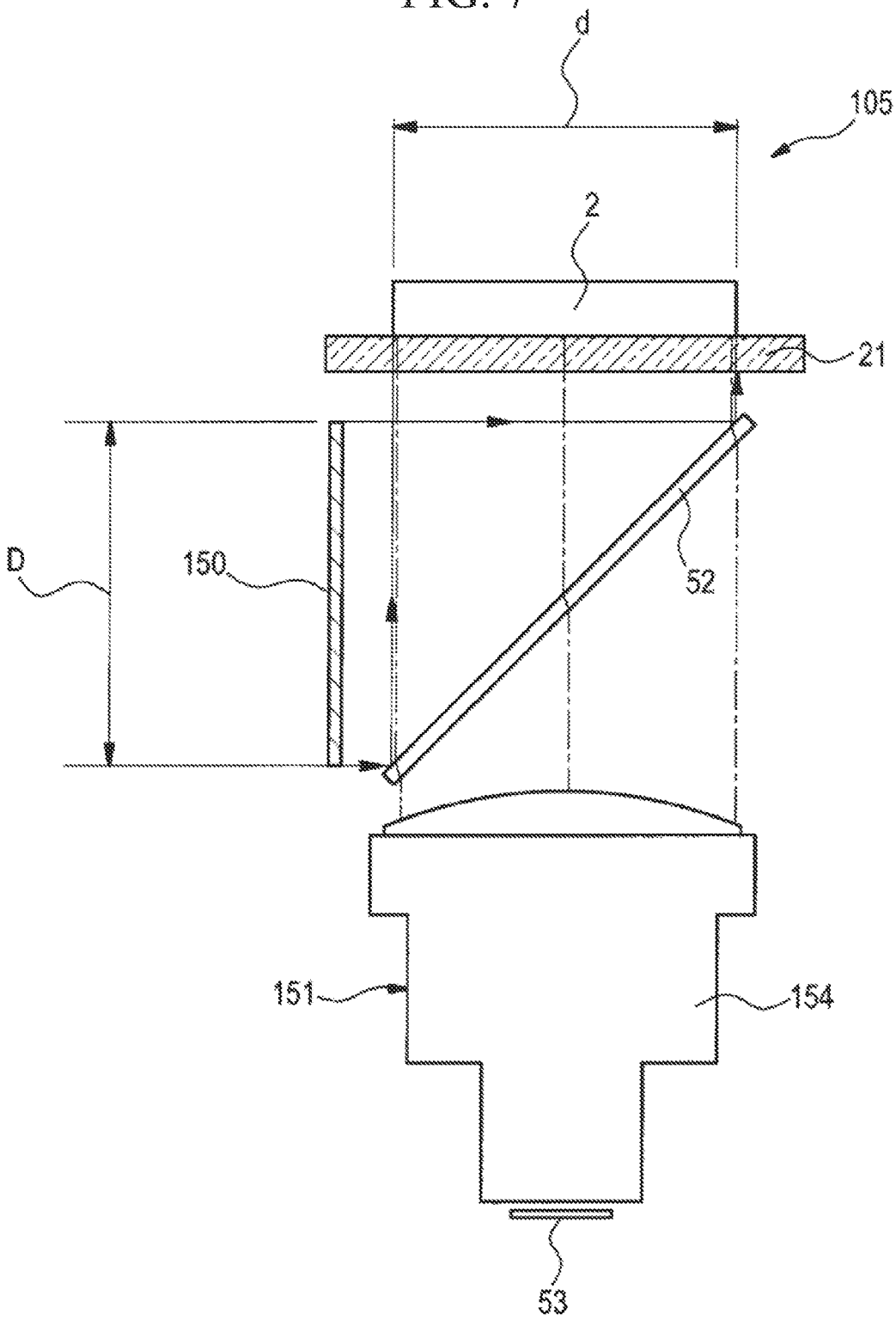
FIG. 7 shows another example of the imaging unit for describing the embodiment of the present invention.

FIG. 7 shows another example of the imaging unit. By giving the same reference numerals to those elements that are shared by the imaging unit 105 shown in FIG. 7 and the imaging unit 5 that is shown in FIG. 3, the explanation is made simple or omitted.

The imaging unit 105 that is shown in FIG. 7 performs imaging by coaxial epi-illumination. In this imaging unit 105, the object side of the imaging optics (optical image forming system) 154 that is included in the imaging unit 151 is made to be a telecentric imaging optics. In this case, for the surface light source 150 to project onto the entire surface of the coin 2, it is sufficient for the diameter D of the surface light source 150 to be the same as the diameter d of the coin. By using a telecentric imaging optics for the imaging optics 154 of the imaging unit 151, it is possible to miniaturize the surface light source 150, and therefore possible to miniaturize the imaging unit 105. By miniaturizing the surface light source 150 and the imaging unit 105, it is possible to realize a reduction in power consumption, uniform illumination, and lower costs. Moreover, by using a telecentric imaging optics, it is possible to obtain a stable image with little distortion, and it is possible to reduce unevenness of color and light quantity by the angular distribution of the light rays that contribute to the image formation becoming narrow.

FIGS. 8A to 8D show brightness distributions of images obtained by imaging the surface of a coin. FIG. 9 shows the illuminance distributions of the illumination light when imaging the images with the brightness distributions of FIGS. 8A to 8D.

Figure 8A:
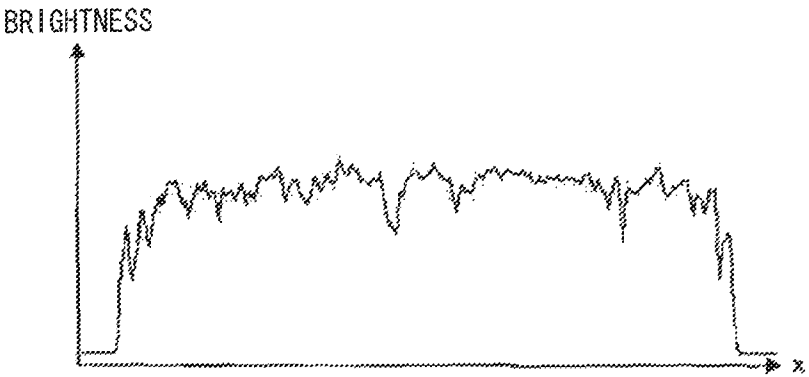
FIG. 8A shows a first brightness distribution of an image that is obtained by imaging the surface of a coin.
Figure 8B:
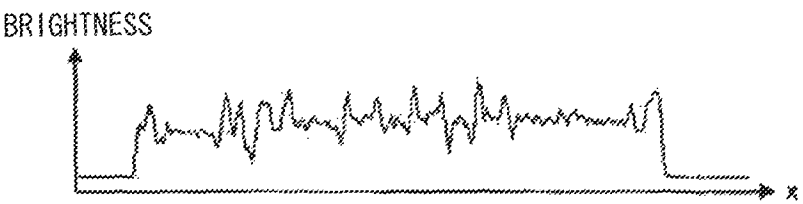
FIG. 8B shows a second brightness distribution of an image that is obtained by imaging the surface of a coin.
Figure 8C:
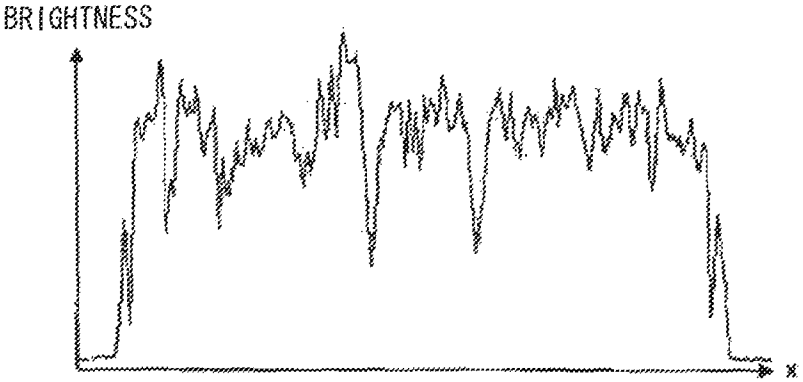
FIG. 8C shows a third brightness distribution of an image that is obtained by imaging the surface of a coin.
Figure 8D:
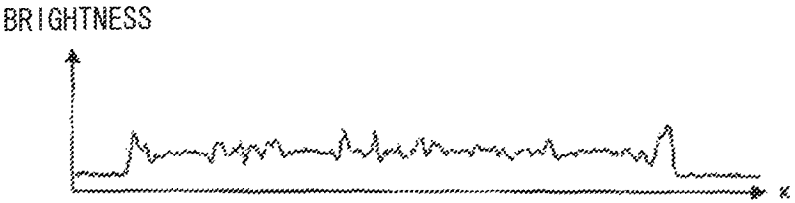
FIG. 8D shows a fourth brightness distribution of an image that is obtained by imaging the surface of a coin.
Figure 9:
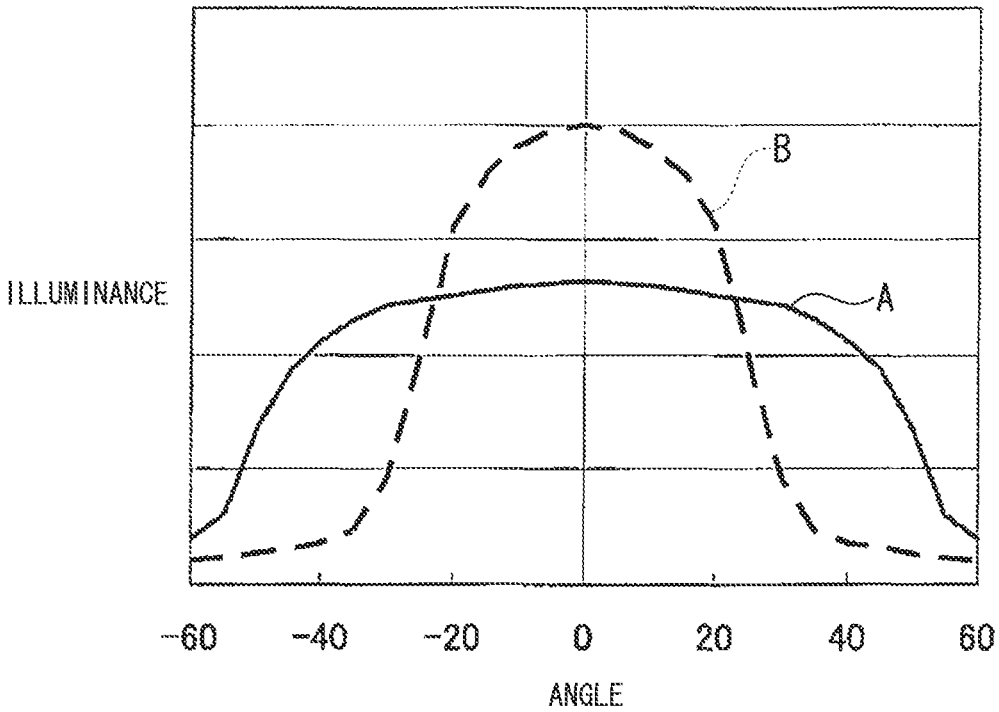
FIG. 9 shows the illuminance distribution of the illumination light when imaging images with the brightness distributions of FIGS. 8A to 8D.

FIG. 8A shows a first brightness distribution of an image obtained by imaging a nickel coin by the imaging unit 105 that emits illumination light including parallel light and diffused light. The nickel coin is such as a 100-yen coin in which the reflectance of the surface is comparatively high. FIG. 8B shows a second brightness distribution of an image obtained by imaging a copper coin by the imaging unit 105. The copper coin is such as a 10-yen coin in which the reflectance of the surface is comparatively low. FIG. 8C shows a third brightness distribution of an image obtained by imaging a nickel coin by an imaging unit that emits illumination light including only parallel light. FIG. 8D shows a fourth brightness distribution of an image obtained by imaging a copper coin by an imaging unit that emits illumination light including only parallel light. All of the first to fourth brightness distributions are brightness distributions on one diameter of the coin, and the edge portion of the unevenness pattern of the surface of the coin corresponds to the valley portions of the brightness distribution. FIG. 9 shows the illuminance distribution of the illumination light of the imaging unit 105 that includes parallel light and diffused light in the illumination light by a solid line A. Also, FIG. 9 shows the illuminance distribution of the illumination light of the imaging unit in which only parallel light serves as the illumination light by a dashed line B.

In the fourth brightness distribution of the cooper coin in the case of the illumination light being only parallel light (FIG. 8D), blocked-up shadows occur due to the luminance of the surface of the coin being low overall, and so the contrast between the edge portion of the unevenness pattern and the other portion of the surface of the coin becomes indistinct. In contrast to this, in the second brightness distribution of the copper coin in the case of the illumination light including diffused light (FIG. 8B), the luminance of the surface of the coin is high overall due to the diffused light, and so the contrast between the edge portion of the unevenness pattern and the other portion of the surface of the coin becomes distinct with no blocked-up shadows.

The average brightness difference between the first brightness distribution of the nickel coin (FIG. 8A) and the second brightness distribution of the copper coin (FIG. 8B) in the case of illumination light including diffused light is smaller compared to the average luminance difference between the third brightness distribution of the nickel coin (FIG. 8C) and the fourth brightness distribution of the copper coin (FIG. 8D) in the case of the illumination light being only parallel light.

From the above, by emitting illumination light that includes parallel light and diffused light on the surface of a coin, it is possible to reliably capture the unevenness pattern of the surface of a coin without being swayed by the nature of the surface thereof, while keeping constant the output of the surface light source 50.

As described above, in the present specification, an imaging unit that images a subject having an unevenness pattern on a surface is disclosed. The imaging unit includes: a surface light source that emits with a constant output illumination light illuminating the surface of the subject; an imager that receives reflected light reflected by the surface of the subject; and a beam splitter that is arranged at a location at which the illumination light emitted from the surface light source and the reflected light incident on the imager intersect with each other. The illumination light emitted from the surface light source is incident on the surface of the subject via the beam splitter. The reflected light reflected by the surface of the subject is incident on the imager via the beam splitter. The illumination light incident on the surface of the subject includes parallel light that is perpendicularly incident on the surface of the subject, and diffused light.

Moreover, in the imaging unit disclosed in the present specification, the diffused light may include light that is obliquely incident on the surface of the subject.

Moreover, in the imaging unit disclosed in the present specification, the imager may include a telecentric imaging optics.

Moreover, in the imaging unit disclosed in the present specification, the subject may be a coin.

Moreover, as described above, in the present specification, a coin identifying apparatus is disclosed. The coin identifying apparatus includes: a conveying unit that conveys a coin; the above-mentioned imaging unit imaging a surface of the coin that is conveyed by the conveying unit; and an identifying unit that identifies the coin based on an image acquired by the imaging unit.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. An imaging unit that images a subject having an unevenness pattern on a surface, the imaging unit comprising:

a surface light source that emits with a constant output illumination light illuminating the surface of the subject;

an imager that receives reflected light reflected by the surface of the subject; and a beam splitter that is arranged at a location at which the illumination light emitted from the surface light source and the reflected light incident on the imager intersect with each other, the illumination light emitted from the surface light source being incident on the surface of the subject via the beam splitter, the reflected light reflected by the surface of the subject being incident on the imager via the beam splitter, the illumination light incident on the surface of the subject including parallel light that is perpendicularly incident on the surface of the subject, and diffused light, the surface light source including: a light source element that emits light; a light guide plate that has, on a lower surface thereof, a prism pattern reflecting the light emitted from the light source element; the light guide plate emitting, from an upper surface thereof, the light reflected by the prism pattern; and a diffusion film that is layered on the upper surface of the light guide plate, the diffusion film dispersing a portion of the light emitted from the upper surface to generate the parallel light and the diffused light.

2. The imaging unit according to claim 1, wherein the diffused light includes light that is obliquely incident on the surface of the subject.

3. The imaging unit according to claim 1, wherein the imager includes a telecentric imaging optics.

4. The imaging unit according to claim 1, wherein the subject is a coin.

5. A coin identifying apparatus comprising:

a conveying unit that conveys a coin;

the imaging unit according to claim 1, the imaging unit imaging a surface of the coin that is conveyed by the conveying unit; and an identifying unit that identifies the coin based on an image acquired by the imaging unit.

* * * * *